US007479054B2

(12) United States Patent
Wittenberg et al.

(10) Patent No.: US 7,479,054 B2
(45) **Date of Patent: *Jan. 20, 2009**

(54) FLEXIBLE DOLLS AND POSABLE ACTION FIGURES

(75) Inventors: Mark S. Wittenberg, Rossmoor, CA (US); Ahmad A. Asbaghi, El Segundo, CA (US)

(73) Assignee: Mattel, Inc., El Segundo, CA (US)

( * ) Notice: Subject to any disclaimer, the term of this patent is extended or adjusted under 35 U.S.C. 154(b) by 373 days.

This patent is subject to a terminal disclaimer.

(21) Appl. No.: 10/945,590

(22) Filed: Sep. 20, 2004

(65) Prior Publication Data

US 2005/0037686 A1 Feb. 17, 2005

Related U.S. Application Data

(63) Continuation of application No. 10/448,943, filed on May 30, 2003, now Pat. No. 6,800,016.

(60) Provisional application No. 60/384,884, filed on May 31, 2002.

(51) Int. Cl.
*A63H 3/02* (2006.01)
*A63H 3/04* (2006.01)

(52) U.S. Cl. ..... 446/373; 446/374; 446/376

(58) Field of Classification Search ..... 446/369, 446/370, 373, 374, 375, 376, 379, 380, 381, 446/382, 383, 486

See application file for complete search history.

(56) References Cited

U.S. PATENT DOCUMENTS

| | | | |
|---|---|---|---|
| 164,582 | A | 6/1875 | Miller |
| 280,986 | A | 7/1883 | Wishard |
| 593,592 | A | 11/1897 | Lyons |
| 807,895 | A | 12/1905 | Allert |
| 1,141,459 | A | 6/1915 | Gregg |
| 1,189,585 | A | 7/1916 | Kruse |

(Continued)

FOREIGN PATENT DOCUMENTS

AU 2719077 1/1979

(Continued)

OTHER PUBLICATIONS

Mattel 1969 Scuba figure.

(Continued)

*Primary Examiner*—John Ricci
(74) *Attorney, Agent, or Firm*—Kolisch Hartwell, PC

(57) ABSTRACT

An improved posable figure having extended life and resistance to failure, and being repeatedly posable in a realistic fashion. The posable figure has an inner skeleton including one or more primary members constructed of a bendable material such as metal wire, and an outer molded body covering constructed of a flexible substance such as an elastomer material. The inner skeleton also may include one or more secondary members molded over portions of the primary members, to limit flexion of the primary members and/or to connect the primary members to form an articulated structure.

9 Claims, 9 Drawing Sheets

U.S. PATENT DOCUMENTS 1,255,446 A 2/1918 Lofgren
1,259,782 A 3/1918 Savage
1,355,799 A 10/1920 Bradish
1,551,250 A 8/1925 Henry
1,590,898 A 6/1926 McAuley
1,626,533 A 4/1927 Hergershausen
1,709,432 A 4/1929 Hill
1,998,864 A 4/1935 Dodge
2,017,023 A 10/1935 Rendle
2,073,723 A 3/1937 Woolnough
2,089,376 A 8/1937 Jacobson
2,109,422 A 2/1938 Haughton
2,134,974 A 11/1938 Hurwitz
2,156,573 A 5/1939 Schaeffer
2,202,805 A 5/1940 Wood
2,340,172 A 1/1944 Buchanan
2,392,024 A 1/1946 Couri
2,451,023 A 10/1948 Dusko
2,474,236 A 6/1949 Durbin
2,601,740 A 7/1952 Schippert
2,606,398 A 8/1952 Miller
2,684,503 A 7/1954 Silver
2,753,659 A 7/1956 Cohn
2,767,517 A 10/1956 Hooper
2,812,616 A 11/1957 Ford
2,845,748 A 8/1958 Derham
3,009,284 A 11/1961 Ryan
3,019,552 A 2/1962 Schleich
3,055,119 A 9/1962 McEwen
3,277,601 A 10/1966 Ryan
3,284,947 A * 11/1966 Dahl ..... 446/374
3,325,939 A 6/1967 Ryan et al.
3,350,812 A 11/1967 Lindsay et al.
3,395,484 A 8/1968 Smith
3,432,581 A 3/1969 Rosen
3,574,968 A 4/1971 Schau et al.
3,584,409 A 6/1971 Chang et al.
3,624,691 A 11/1971 Robson et al.
3,693,292 A 9/1972 Di Leva
3,699,714 A 10/1972 Johnson et al.
3,706,330 A 12/1972 Rightmire et al.
3,716,942 A 2/1973 Garcia et al.
3,852,389 A 12/1974 Adler et al.
3,895,451 A 7/1975 Smrcka
3,918,196 A 11/1975 Schleich
3,921,332 A 11/1975 Terzian et al.
3,939,604 A 2/1976 Nishizawa
3,955,309 A 5/1976 Noble
3,955,312 A 5/1976 Pugh
4,028,845 A 6/1977 Licitis
4,118,888 A 10/1978 Ogawa
4,123,872 A 11/1978 Silva
4,136,484 A 1/1979 Abrams
4,169,336 A 10/1979 Kuhn
4,170,425 A 10/1979 Brown
4,170,840 A 10/1979 Ogawa
4,197,358 A 4/1980 Garcia
4,206,564 A 6/1980 Ogawa
4,219,958 A 9/1980 Shulyak
4,233,775 A 11/1980 Neufeld
4,274,224 A 6/1981 Pugh et al.
4,295,291 A 10/1981 Fukui
4,440,784 A 4/1984 Katsumi et al.
4,470,784 A 9/1984 Piotrovsky
4,565,376 A 1/1986 Croll
4,613,315 A 9/1986 Kataoka
4,666,417 A 5/1987 Hillman
4,767,505 A 8/1988 Satoh et al.
4,802,858 A 2/1989 Lindskog et al.
4,802,878 A 2/1989 Terzian et al.
4,884,991 A 12/1989 Terzian
4,892,501 A 1/1990 Girelli
4,908,001 A 3/1990 Kopian
4,932,919 A 6/1990 Shapero
4,952,190 A 8/1990 Tarnoff et al.
4,954,118 A 9/1990 Refabert
4,955,844 A 9/1990 Miller, Jr.
4,964,836 A 10/1990 Kamei
5,017,173 A 5/1991 Shapero et al.
5,083,732 A 1/1992 Akamine
5,083,966 A 1/1992 Blank
5,090,936 A 2/1992 Satoh et al.
5,162,013 A 11/1992 von Mohr
5,162,190 A 11/1992 Zahn et al.
5,255,457 A 10/1993 Lipson
5,297,443 A 3/1994 Wentz
5,516,314 A 5/1996 Anderson
5,630,745 A 5/1997 Yeh
5,741,140 A 4/1998 Bristol
5,762,531 A 6/1998 Witkin
5,766,701 A 6/1998 Lee
5,800,242 A 9/1998 Clokey
5,800,243 A 9/1998 Berman
5,836,802 A 11/1998 Harnett
5,939,480 A 8/1999 Lee et al.
5,989,658 A 11/1999 Miura et al.
6,074,270 A 6/2000 Wilcox et al.
6,110,002 A 8/2000 Langton
6,155,904 A 12/2000 Spector
6,170,721 B1 1/2001 Chen
6,176,756 B1 1/2001 Panec
6,217,406 B1 4/2001 Ross
6,220,922 B1 4/2001 Lee et al.
6,237,759 B1 5/2001 Wotton
6,264,526 B1 7/2001 Meeker
6,267,640 B1 7/2001 Akashi et al.
6,350,664 B1 2/2002 Haji et al.
6,353,263 B1 3/2002 Dotta et al.
6,365,840 B1 4/2002 Honda et al.
6,524,519 B1 2/2003 Ohba et al.
6,800,016 B2 * 10/2004 Wittenberg et al. ..... 446/373

FOREIGN PATENT DOCUMENTS

CA 831223 7/1916
DE 343128 10/1921
DE 412263 4/1925
DE 456557 8/1928
DE 887474 7/1953
DE 4040737 3/1991
DE 4138736 6/1992
DE 4208081 9/1993
DE 19960540 1/2001
DE 10000309 4/2001
DE 10016378 5/2001
EP 0566799 10/1993
EP 1010784 6/2000
EP 1057506 6/2000
EP 1052002 11/2000
EP 0743083 12/2000
EP 1108454 6/2001
EP 1097740 9/2001
FR 632811 3/1927
FR 1060435 4/1954
GB 155806 12/1921
GB 0279157 10/1927
GB 0581338 10/1946
GB 1137642 12/1968
GB 1402235 8/1975
GB 1571352 7/1980
GB 2134403 7/1984
GB 2184032 6/1987
GB 2197800 6/1988
GB 2215227 9/1989

| | | |
|---|---|---|
| GB | 2239625 | 7/1991 |
| GB | 2346815 | 9/2000 |
| GB | 2348847 | 10/2000 |
| GB | 2350308 | 11/2000 |
| GB | 2354181 | 3/2001 |
| GB | 2361194 | 10/2001 |
| JP | 56049211 | 5/1981 |
| JP | 58127679 | 2/1983 |
| JP | 60157815 | 8/1985 |
| JP | 62071616 | 4/1986 |
| JP | 6194720 | 5/1986 |
| JP | 6194721 | 5/1986 |
| JP | 6194722 | 5/1986 |
| JP | 6194723 | 5/1986 |
| JP | 61125367 | 5/1986 |
| JP | 61169217 | 7/1986 |
| JP | 61191496 | 8/1986 |
| JP | 63103685 | 7/1988 |
| JP | 11221369 | 4/1989 |
| JP | 1314584 | 5/1989 |
| JP | 1080391 | 6/1989 |
| JP | 1221192 | 6/1989 |
| JP | 1036422 | 7/1989 |
| JP | 2295587 | 6/1990 |
| JP | 2243184 | 9/1990 |
| JP | 2114983 | 10/1990 |
| JP | 2104386 | 11/1990 |
| JP | 2252509 | 11/1990 |
| JP | 2159291 | 12/1990 |
| JP | 3016581 | 1/1991 |
| JP | 3015401 | 4/1991 |
| JP | 3292984 | 12/1991 |
| JP | 4005987 | 1/1992 |
| JP | 4288187 | 10/1992 |
| JP | 5208077 | 8/1993 |
| JP | 8182864 | 7/1996 |
| JP | 9313740 | 12/1997 |
| JP | 1022278 | 1/1998 |
| JP | 10118340 | 1/1998 |
| JP | 10165656 | 12/1998 |
| JP | 10258186 | 12/1998 |
| JP | 2000061151 | 2/2000 |
| JP | 2000061152 | 2/2000 |
| WO | WO9939793 | 8/1999 |
| WO | WO0010665 | 6/2000 |
| WO | WO0032288 | 8/2000 |
| WO | WO0038810 | 10/2000 |
| WO | WO0108776 | 7/2001 |
| WO | WO0187443 | 11/2001 |

OTHER PUBLICATIONS

Mattel 1970 Rock Flower doll.
1981 Jenny doll.
GI Joe Action Soldier 1994 Commemorative Editon.
Mattel 2000 Millennium Barbie.
Mary Kate & Ashley Oct. 7, 2002 version.
1994 TMP Toys Ghoul with pivoted mouth.

* cited by examiner

FLEXIBLE DOLLS AND POSABLE ACTION FIGURES

CROSS REFERENCE TO RELATED APPLICATIONS

This is a continuation application of U.S. patent application Ser. No. 10/448,943, filed on May 30, 2003, now U.S. Pat. No. 6,800,016, which in turn claims the benefit of U.S. Provisional Patent Application Ser. No. 60/384,884, filed May 31, 2002. Both applications are incorporated herein by reference in their entirety for all purposes.

FIELD OF THE INVENTION

The present disclosure relates generally to flexible doll toys and posable action figure toys. More particularly, it includes dolls and action figures with an outer surface constructed from a soft, flesh-like material, and a bendable inner skeleton.

BACKGROUND OF THE INVENTION

Many different varieties of flexible dolls and action figures have been developed over the years, mainly for the purposes of entertainment and display. Creation of a flexible or posable figure generally requires creation of a movable articulated body and limbs, ideally configured to retain whatever pose the figure is placed into. Furthermore, it is desirable that the figure be posable a large number of times without failure of the structure.

One class of posable figures includes an inner armature or skeleton, possibly including joints to recreate the articulation of a human skeleton, and a molded outer covering or body constructed of a flexible material that surrounds and is bonded or otherwise anchored to the inner skeleton. Examples of such toys are found in U.S. Pat. Nos. 280,986, 1,189,585, 1,551,250, 1,590,898, 2,017,023, 2,073,723, 2,109,422, 2,392,024, 2,601,740, 2,684,503, 3,325,939, 3,284,947, 3,395,484, 3,624,691, 3,955,309, 4,123,872, 4,136,484, 4,233,775, 4,932,919, 4,954,118, 4,964,836, 5,516,314, 5,630,745, 5,762,531, 5,800,242, 6,155,904, and 6,217,406, and in publications JP49-18954, JP49-18955, JP60-97067, JP61-94090, JP61-94091, JP61-94092, JP62-53686, JP62-164092, JP63-103685, JP11-212369, WO0067869, and WO0010665. Other examples of flexible doll toys and action figure toys are found in U.S. Pat. Nos. 3,277,601, 3,716,942, 4,470,784, 4,932,919, 5,017,173, and 6,074,270, and in publication WO0108776. The disclosures of all of these patents and publications are incorporated herein by reference.

SUMMARY OF THE INVENTION

An improved posable figure is provided, having extended life and resistance to failure, and being repeatedly posable in a realistic fashion. The posable figure has an inner skeleton including one or more primary members constructed of a bendable material such as metal wire, and an outer molded body covering constructed of a flexible substance such as an elastomer material. The inner skeleton also may include one or more secondary members molded over portions of the primary members, to limit flexion of the primary members and/or to connect the primary members to form an articulated structure.

The advantages of the posable figure provided will be understood more readily after a consideration of the Drawings and the Detailed Description of the Preferred Embodiment.

DETAILED DESCRIPTION OF THE PREFERRED EMBODIMENT

Figures 1, 4:
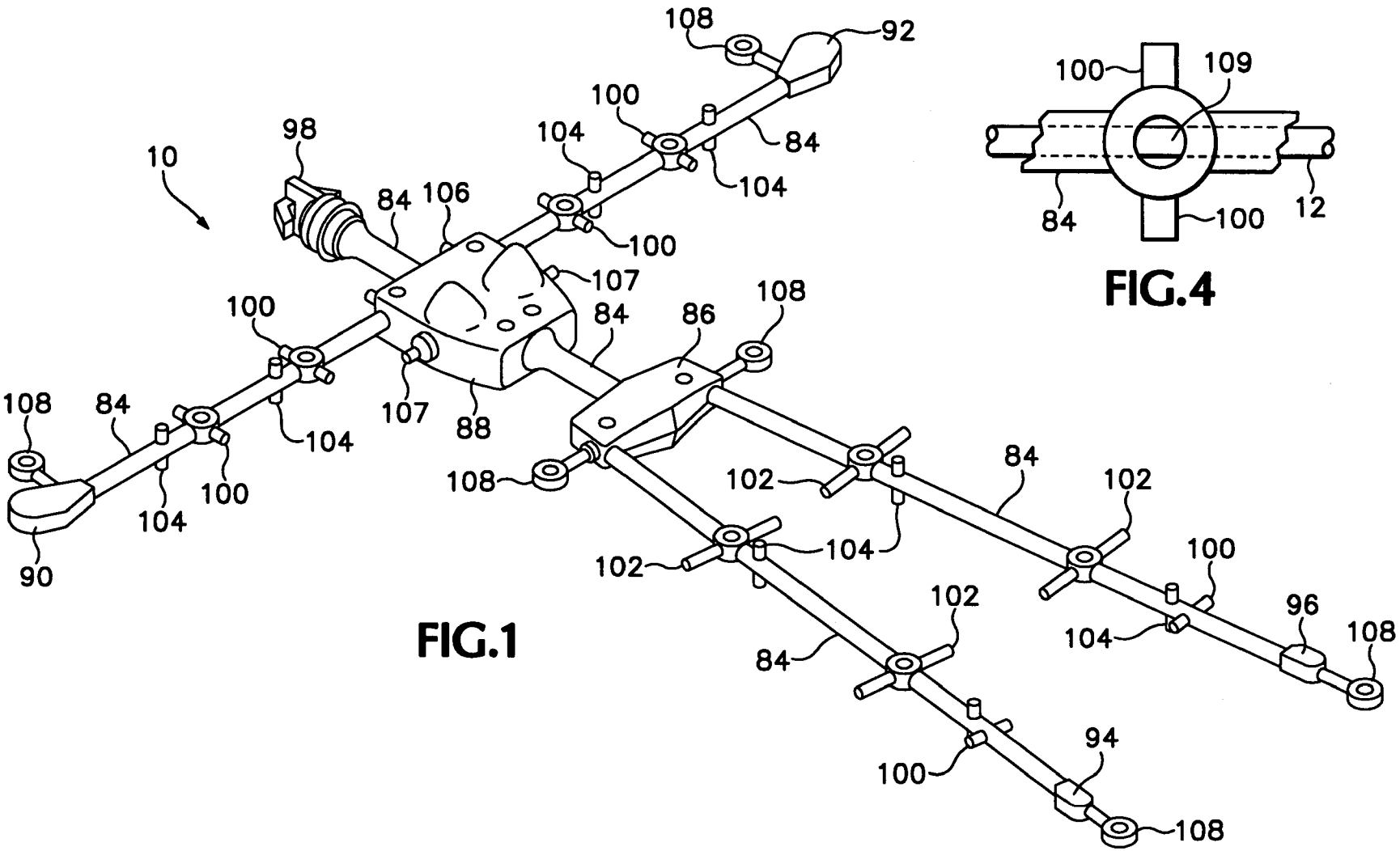
FIG. 1 is a perspective view of an inner skeleton for a posable figure, according to an embodiment of the invention.
FIG. 4 is a magnified view of a portion of an inner skeleton for a posable figure, showing locating pins and related structure.

Referring to FIG. 1, an inner skeleton for a posable figure is shown and generally indicated at 10. Although it is anticipated that inner skeleton 10 will eventually be enclosed by and bonded to an outer covering, such as an injection-molded body of a posable figure, FIG. 1 shows the inner skeleton in isolation for clarity. Skeleton 10 includes one or more flexible primary members that may be coated and/or joined together to form an articulated structure. The primary members may be joined in an insert molding process, referred to hereinafter as a skeleton-forming process, that molds one or more secondary members over portions of the primary members, as described below.

Figure 2:
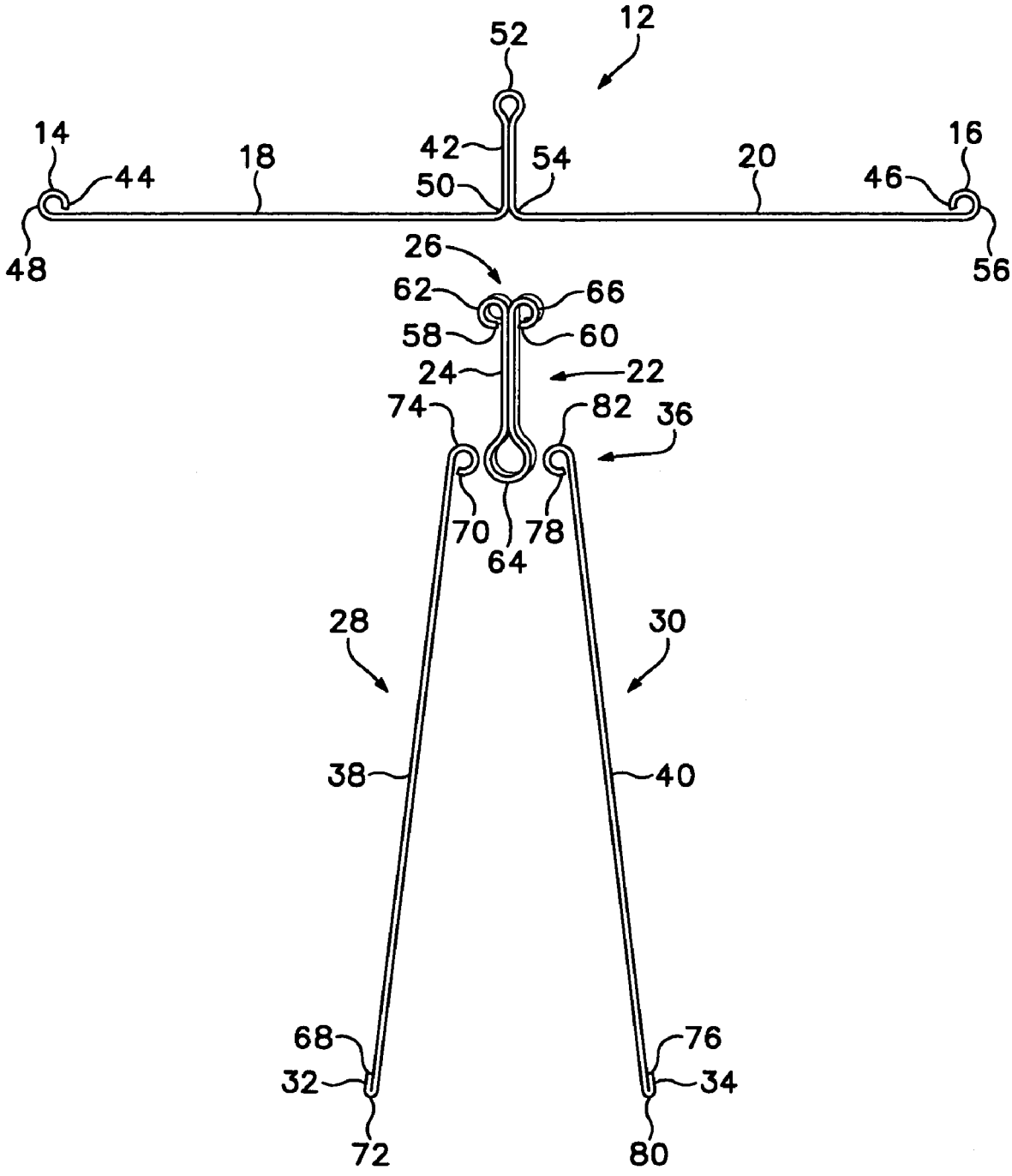
FIG. 2 is a front elevational view of several primary members of the inner skeleton of FIG. 1.

FIG. 2 shows several primary members of the skeleton of FIG. 1, before the skeleton-forming process. In this embodiment, skeleton 10 includes a primary upper member 12, extending from a first hand portion 14 to a second hand portion 16 of the skeleton and defining arm portions 18 and 20. The skeleton also includes a primary torso member 22 defining a waist portion 24 and a chest portion 26, and two primary leg members 28 and 30 extending from foot portions 32 and 34 to a hip portion 36 and defining leg portions 38 and 40.

The primary members may be constructed from any flexible, resilient material, such as strands of metal wire. In the embodiment depicted in FIG. 2, each wire of the primary members has the same diameter and is constructed from the same material. In particular, the primary members depicted in FIG. 2 are constructed from stainless steel wires, each with a diameter of approximately 1.4 millimeters. However, it will be appreciated that wires of other diameters and/or constructed from other materials may be equally suitable or more suitable for various skeleton designs, depending on the overall size of the posable figure and its intended use. For instance, two or three strands of twisted wire could be used to define some or all of the primary members.

As seen in FIG. 2, primary upper member 12 includes a single wire extending from one hand portion to the other, so that a single wire is found in a cross-section of each arm portion 18 and 20. The wire of primary upper member 12 is bent or doubled over in a neck portion 42, so that two wires are found in a cross-section of the neck portion. Primary leg members 28 and 30 each include a single wire extending from one of the foot portions to hip portion 36, so that a single wire is found in a cross-section of each leg portion. Primary torso member 22 includes two wires extending through waist portion 24, and both are doubled over so that four wires are found in a cross-section of the waist portion.

Each primary member has two ends, with at least one intermediate bend between the two ends. The intermediate bends are provided to retain secondary members that will be molded to partially surround the primary members, as described in more detail below. Specifically, primary upper member 12 has a first end 44 disposed in hand portion 14, and a second end 46 disposed in hand portion 16. An intermediate bend 48 is disposed near first end 44, three other intermediate bends 50, 52, and 54 are disposed in neck portion 42, and yet another intermediate bend 56 is disposed near second end 46 of the primary upper member.

Primary torso member 22 has a first end 58 and a second end 60, and includes a first intermediate bend 62 disposed near first end 58, another intermediate bend 64 disposed in hip portion 36, and another intermediate bend 66 disposed near second end 60. Primary leg member 28 has a first end 68 and a second end 70, with an intermediate bend 72 disposed near first end 68 and another intermediate bend 74 disposed near second end 70. Similarly, primary leg member 30 has first and second ends 76 and 78, with intermediate bends 80 and 82 disposed near the first and second ends, respectively.

Referring back to FIGS. 1-2 in conjunction with each other, the wires forming the primary members are held within a mold (not shown) shaped to define the finished skeleton, and bonded into an integral structure in a skeleton-forming process. During the skeleton-forming process, portions of the wires forming the primary members are coated with a layer of polymer resin material, generally indicated at 84. Coating the wires in this manner may decrease the likelihood of a wire fraying and/or poking through an outer covering surrounding the skeleton, thus increasing the safety and durability of the posable figure. Also during the skeleton-forming process, various secondary members, also covering portions of the primary members, are formed from substantially thicker layers of resin.

Figure 3:
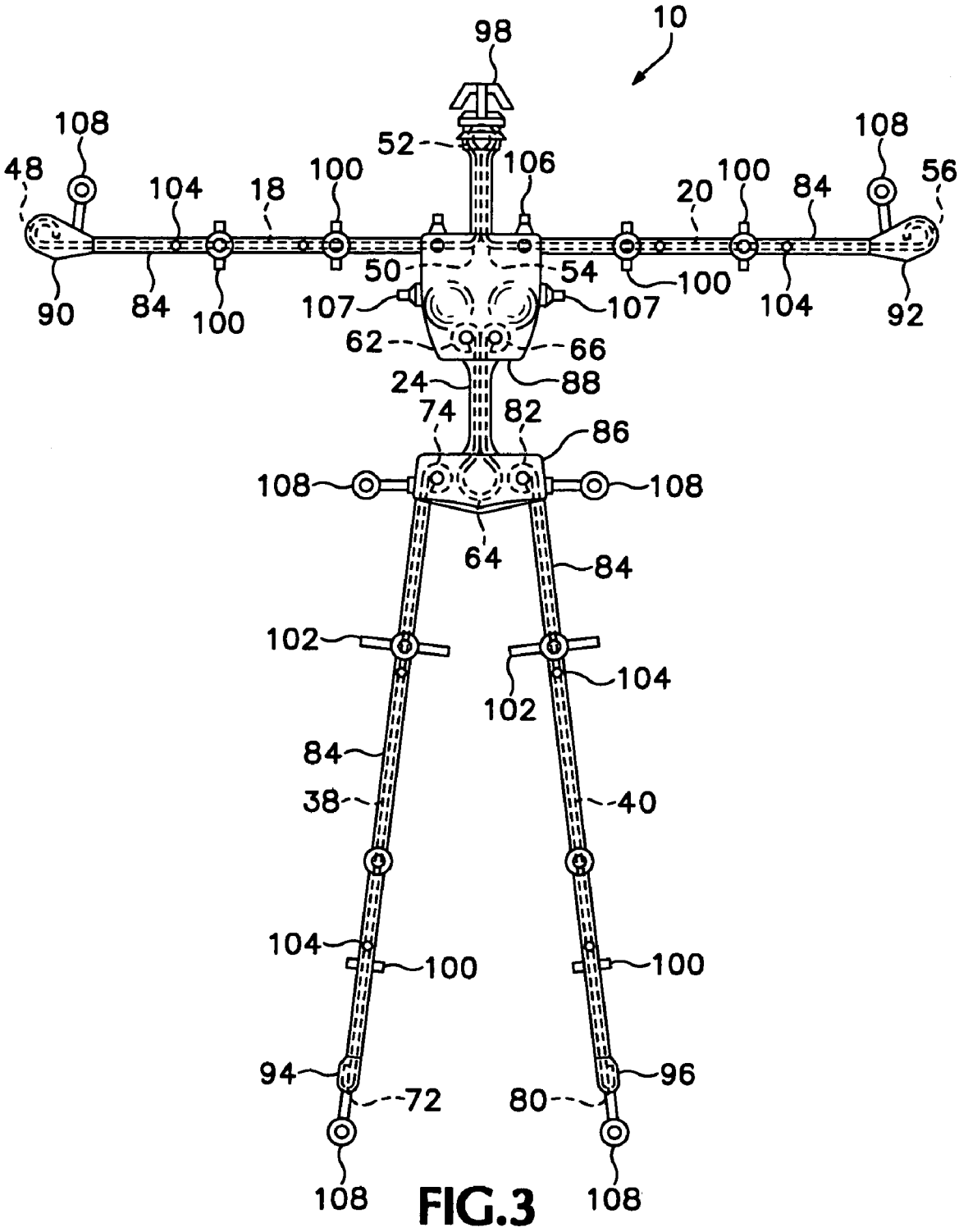
FIG. 3 is a front elevational view of the inner skeleton of FIG. 1, showing primary members disposed within the skeleton.

FIG. 3 shows a front plan view of inner skeleton 10 after the skeleton-forming process has molded polymer resin around portions of the primary members. The resin material, which may be polypropylene, is flexible enough to allow bending in portions where it covers the primary members in a relatively thin layer. By varying the thickness of resin material surrounding the various portions of wire, different amounts of flexibility may be imparted to different portions of the skeleton, even though only a single layer of resin is injected around the wires in the first injection or insert molding step. In particular, polypropylene is flexible enough to allow bending of the wires in portions where the polypropylene is molded to be less than about 2 millimeters (2-mm) thick, and preferably to be about 1-mm thick.

In the embodiment depicted in FIG. 3, waist portion 24, arm portions 18 and 20, leg portions 38 and 40, and neck portion 42 are all covered with a layer of polypropylene, approximately 1-mm thick, during the skeleton-forming process, so that these portions of the skeleton remain bendable. During the same process, various secondary members are formed from substantially thicker layers of resin. The secondary members cover portions of the primary members and couple the primary members together to form an integral structure.

As shown in FIG. 3, the secondary members may include a secondary hip member 86, a secondary chest member 88, secondary hand members 90 and 92, and secondary foot members 94 and 96. Due to their thickness, the secondary members limit flexion of various portions of the skeleton. In particular, flexion of the skeleton is limited in portions of the skeleton where the primary members are covered by the secondary members, and also in portions of the skeleton occupied by the secondary members but not by the primary members.

As described previously and as best seen in FIG. 2, the primary members of the skeleton each include at least one intermediate bend. Each intermediate bend of the primary members is designed to securely retain one of the secondary members at a predefined location on the primary member, when the secondary members are molded over the primary members. Secure retention of the secondary members is accomplished, for example, due to increased surface area provided by each bend of the primary members, and also due to the curvature of each bend providing resistance to tensional forces that might be exerted on the skeleton to pull it apart.

For example, as seen in FIG. 3, intermediate bends 64, 74, and 82 retain secondary hip member 86. Similarly, intermediate bends 50, 54, 62, and 66 retain secondary chest member 88. Intermediate bends 48 and 56 retain secondary hand members 90 and 92, respectively, and intermediate bends 72 and 80 retain secondary foot members 94 and 96, respectively. A retaining clip 98 for a head of the toy may be molded during the same skeleton-forming process that forms the secondary members, from the same material. Intermediate bend 52 in primary upper member 12 retains clip 98 in a manner analogous to retention of the secondary members by the other intermediate bends.

Still referring to FIG. 3, various support members also may be molded during the skeleton-forming process. These support members may include various locating pegs 100, 102, 104, 106, and 107, and locating sprues 108, among others. The support members may extend outward from the primary and/or secondary members, adding structure and stability to inner skeleton 10. As described in more detail below, the support members may also be configured to allow inner skeleton 10 to be located accurately and conveniently in a mold in preparation for another injection molding step.

FIG. 4 shows a close-up view of an arm portion of the posable figure of FIG. 1, showing in detail one of locating pegs 100 used to center the armature within a subsequent mold. It will be noted in FIG. 4 that small portions 109 of the wire of primary upper member 12 remain exposed after the skeleton-forming process, until the skeleton is covered with resilient material in one or more subsequent molding processes. Portions 109 of exposed wire are the result of intrusions into the mold used in the skeleton-forming process, the intrusions (not shown) holding the wire in place as skeleton-forming resin is injected around the primary members.

The support members are formed during the same skeleton-forming process that forms the secondary members, and are therefore constructed from the same material as the secondary members, typically a polymer resin material such as polypropylene or polyethylene. The support member material may also be a thermoplastic elastomer material such as polyvinylchloride (PVC), or a styrene-based elastomer such as a Kraton material manufactured by Kraton Polymers of Houston, Tex., among others. In some embodiments, this material may be chosen to bond and/or be otherwise compatible with a material used for the outer covering of the toy figure.

As is best seen in FIG. 1, the locating pegs each may extend substantially radially outward from the primary members, and may be configured to assist in positioning inner skeleton 10 in a desired location within a mold prior to a subsequent injection molding step. For example, a particular locating peg may be configured to substantially span a radius of the mold, thereby holding a portion of the inner skeleton spaced away from the walls of the mold. This may allow material to be injected into the mold to form a continuous molded body, encasing and bonded to the inner skeleton, with the inner skeleton spaced away from the surface of the body.

In particular, in the embodiment of FIG. 1, locating pegs 100 extend radially away from the primary upper member and the primary leg members in the plane of skeleton 10. When skeleton 10 is placed into a mold, pegs 100 may abut the walls of the mold to securely hold the skeleton in place. When an outer covering (or body) material is placed in the mold, it will surround the skeleton by filling in the empty portions of the mold, so that the locating pegs extend to an outer surface of the finished figure. Thus, pegs 100 may define a width of the arms and lower legs of the finished posable figure in the plane of the skeleton.

Locating pegs 102 are similar to pegs 100, but extend further from the primary leg members and may define a width of the upper legs of the finished figure in the plane of the skeleton. Locating pegs 104 extend radially away from the primary members in directions orthogonal to the plane of the skeleton, and may define widths of the arms and legs in those directions. Similarly, locating pegs 106 of the secondary chest member extend above the secondary chest member, and locating pegs 107 of the secondary chest member extend laterally from the secondary chest member. These pegs may help to securely locate the secondary chest member within a mold and to define the dimensions of the finished figure.

It will be appreciated that although one convenient configuration of locating pegs is depicted in FIG. 1, alternative placements of locating pegs relative to the primary and secondary members of the skeleton are possible. In addition, although the locating pegs are depicted in FIG. 1 as substantially cylindrical, they may have any other suitable shape. For example, the locating pegs may be substantially conical or frustoconical, and they may also have rounded ends to conform to the curvature of an inner surface of a mold.

Sprues 108 may be substantially cylindrical or toroidal, and may serve to further locate inner skeleton 10 in a mold during further subsequent body molding steps. For example, the sprues may be placed in corresponding depressions or recesses in a mold, to hold the inner skeleton in position while a surrounding body or a portion thereof is injection molded around the inner skeleton. As is best seen in FIG. 1, sprues 108 may be variously disposed near secondary hand members 90 and 92, secondary hip member 86, and secondary foot members 94 and 96.

As described previously, inner skeleton 10 is located in a mold in order to form a resilient, flexible body covering around the inner skeleton. In some embodiments, the body covering is molded in a two-step body molding process, and is formed from two different materials which differ in their elastic properties. In other embodiments, the body covering may be molded in a single body molding step, and therefore may be formed from a single elastic material. Various embodiments are described below and depicted in the Drawings.

In cases where the body covering is molded from two different materials, it may be desirable to mold some portions of the body covering from a relatively soft material, and to mold other portions of the body covering from a relatively hard material. For example, the Shore hardness of the soft material may be approximately 14, and the Shore hardness of the hard material may be approximately 40. More specifically, the first material (Shore hardness 14) may be obtained from the Riken Corporation of Tokyo, Japan, under the identifier Leostemer LFR9904N, and the second material (Shore hardness 40) may also be obtained from Riken, under the identifier Leostemer LFR9810N.

Figure 5:
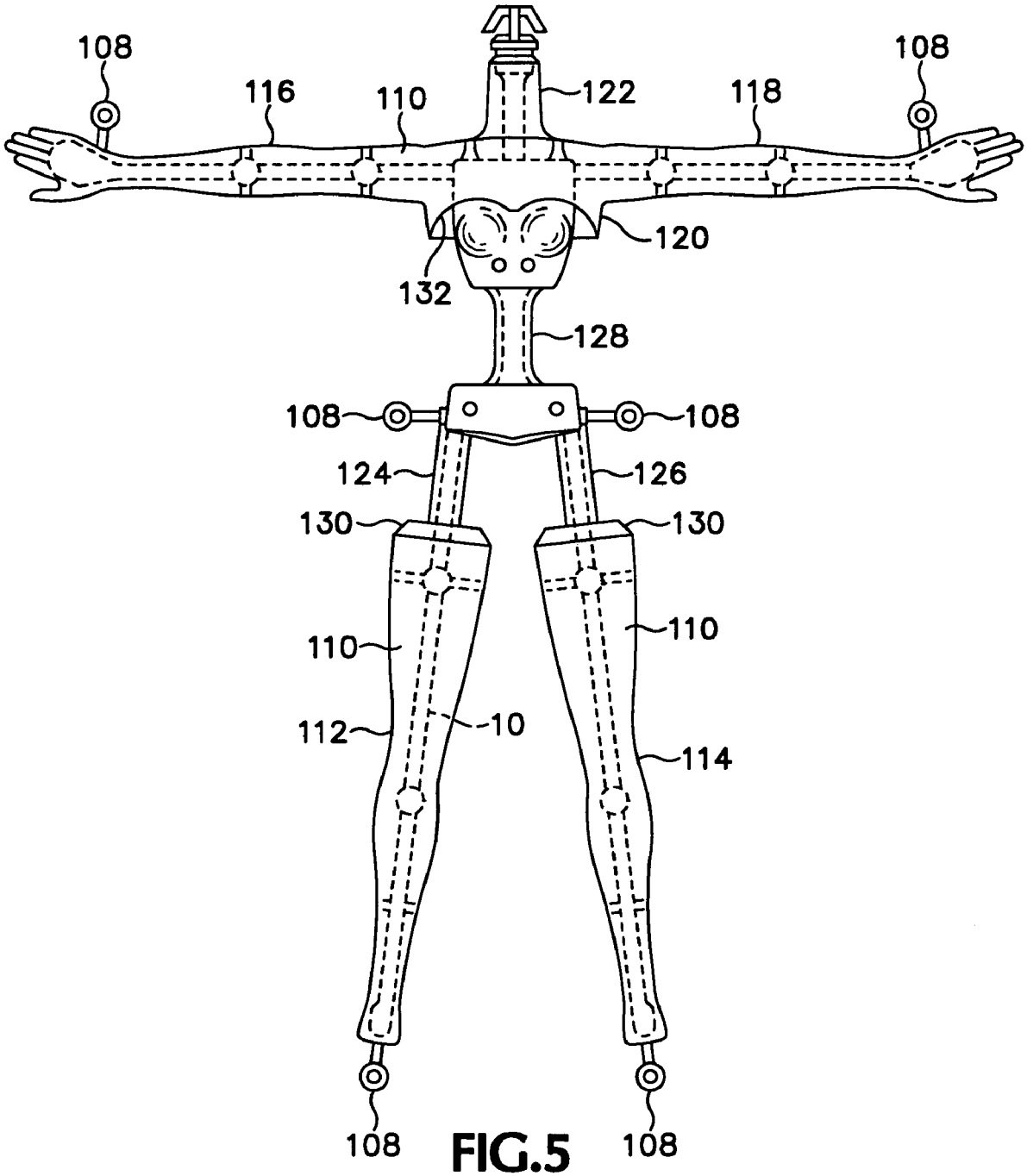
FIG. 5 is a front elevational view of a partially formed posable figure according to an embodiment of the invention, showing an inner skeleton disposed within the figure.

FIG. 5 depicts inner skeleton 10 of FIG. 1 with a first resilient, flexible body material, generally indicated at 110, molded around various portions of the skeleton in a first body molding step. The first body material defines finished lower legs 112 and 114, finished arms 116 and 118, a finished upper chest 120, and a finished neck 122. In addition, the first body material has been molded around upper portions 124 and 126 of the primary leg members and around a middle portion 128 of the primary torso member, to form an unfinished surface extending only partially towards the outer surface of the finished figure. The first body material thickens portions 124, 126, and 128 around the primary members, limiting flexion of the figure in those portions.

In FIG. 5, the first body material is shown molded around upper portions 124 and 126 of the primary leg members and around middle portion 128 of the primary torso member to a diameter of approximately 2-mm. Thus, in this embodiment these portions are each covered first with approximately 1-mm of a resin material during the skeleton-forming process, and then with approximately 2-mm of the first body material during the first body molding step. As described below, a second body material will be molded around the first body material to form the finished body in portions 124, 126, and 128.

FIG. 5 also shows how the first body material is molded into a frustoconical shape, or a taper 130, at the proximal end of each finished lower leg. Such a taper may improve the outer appearance, bending properties, and durability of the posable figure at a juncture of the two body materials in the legs. Similarly, the particular juncture structure 131 shown in the chest region of the toy improves the outer appearance, bending properties, and durability of the toy.

Figure 6:
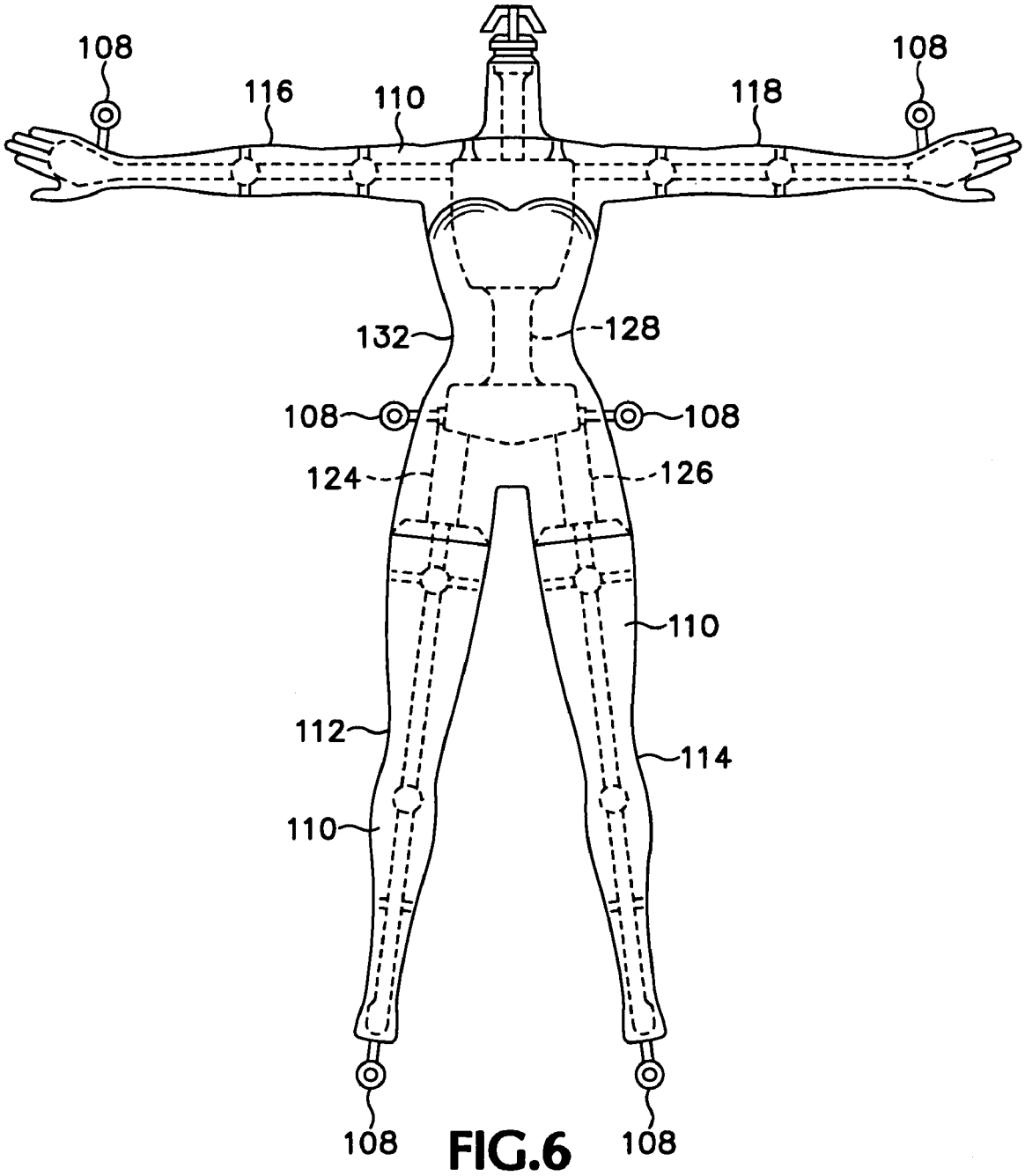
FIG. 6 is a front elevational view of the posable figure of FIG. 5, after an additional body molding step.

FIG. 6 depicts the posable figure of FIG. 5 after a second body molding step in which a second resilient, flexible body material, generally indicated at 132, has been molded around portions 124, 126, and 128 to form a finished body. As described previously, the second body material is typically an elastomer similar to the first body material, but with a different Shore hardness. As seen in FIGS. 5-6, sprues 108 protrude from the finished body, and are typically removed during final manufacturing steps. Other final manufacturing steps may include adding a head, clothing, paint, and/or other accessories (not shown) to the posable figure.

Figure 7:
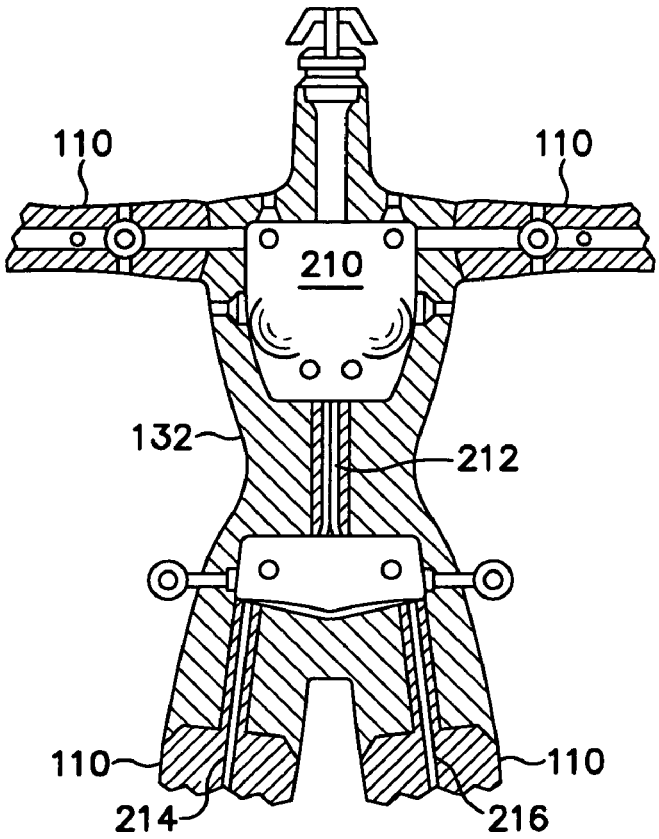
FIG. 7 is a partial front sectional view of a portion of an alternative embodiment of a posable figure.

FIG. 7 depicts a partial sectional view of an alternative embodiment of a posable figure formed in a multi-step molding process. The figure depicted in FIG. 7 includes an inner skeleton 210 similar to inner skeleton 10 of FIG. 1, including a primary torso member 212, and primary leg members 214 and 216. The primary members of this embodiment are joined together in a skeleton-forming process as previously described, except that the primary members are not coated with a thin layer of resin during the initial skeleton-forming molding process. Furthermore, in this embodiment, primary torso member 212 of the skeleton includes only a single wire. After the skeleton-forming process, the embodiment of FIG. 7 is then molded with first and second surrounding body materials 110 and 132. Body materials 110 and 132 may be applied to skeleton 210 in a two-step process, as described previously and as shown in the embodiment of FIGS. 5-6.

Figure 8:
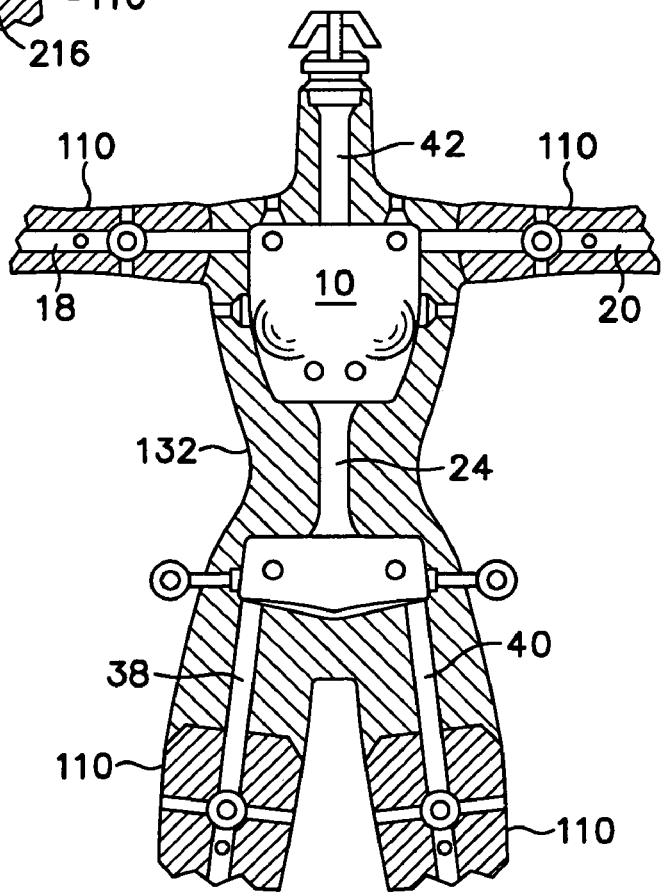
FIG. 8 is a partial front sectional view of a portion of another alternative embodiment of a posable figure.

Another alternative embodiment of a posable figure is depicted in FIG. 8. The inner skeleton of the depicted embodiment is substantially identical to skeleton 10, which is shown in FIG. 1 and which has been described previously. First resilient, flexible body material 110 is molded over arm portions 18 and 20, and leg portions 38 and 40 of the skeleton. However, first body material 110 is not applied to the neck or upper chest portions of the skeleton as in the previous embodiments, nor is it used to thicken the remaining exposed primary members. Second body material 132 is then molded over waist portion 24 of skeleton 10, and also over the leg, neck and upper chest portions that were left exposed when the first body material was molded.

Figure 9:
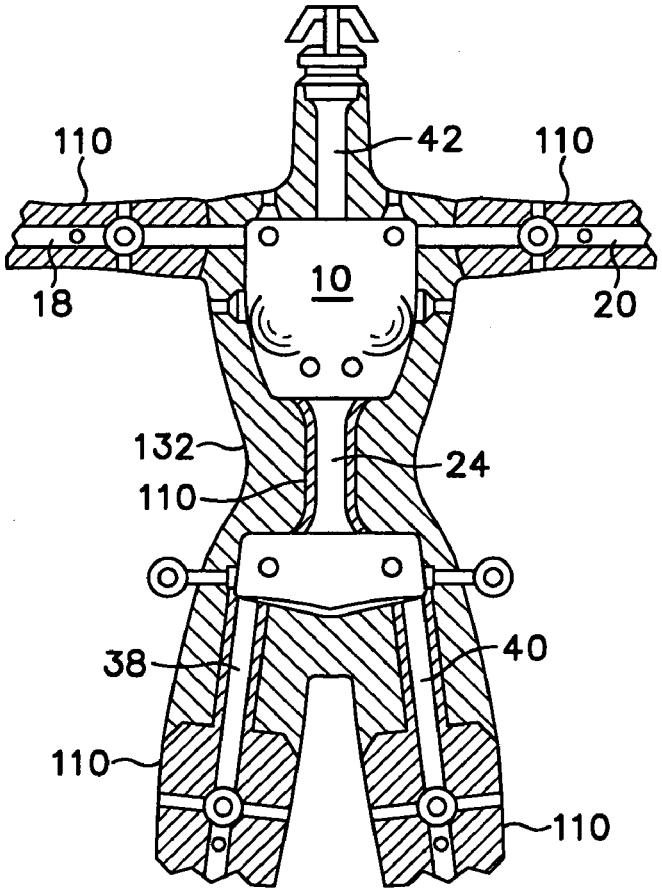
FIG. 9 is a partial front sectional view of a portion of another alternative embodiment of a posable figure.

Still another alternative embodiment of a posable figure is depicted in FIG. 9. The embodiment of FIG. 9 includes inner skeleton 10, and is similar to the embodiment described above and depicted in FIG. 8. However, first body material 110 is molded around waist portion 24 and leg portions 38 and 40 of the skeleton during the first body molding process, to limit flexion of the skeleton in those portions. Second body material 132 is then molded over waist portion 24 of the skeleton, and also over the leg, neck and upper chest portions that were left exposed when the first body material was molded.

Figure 10:
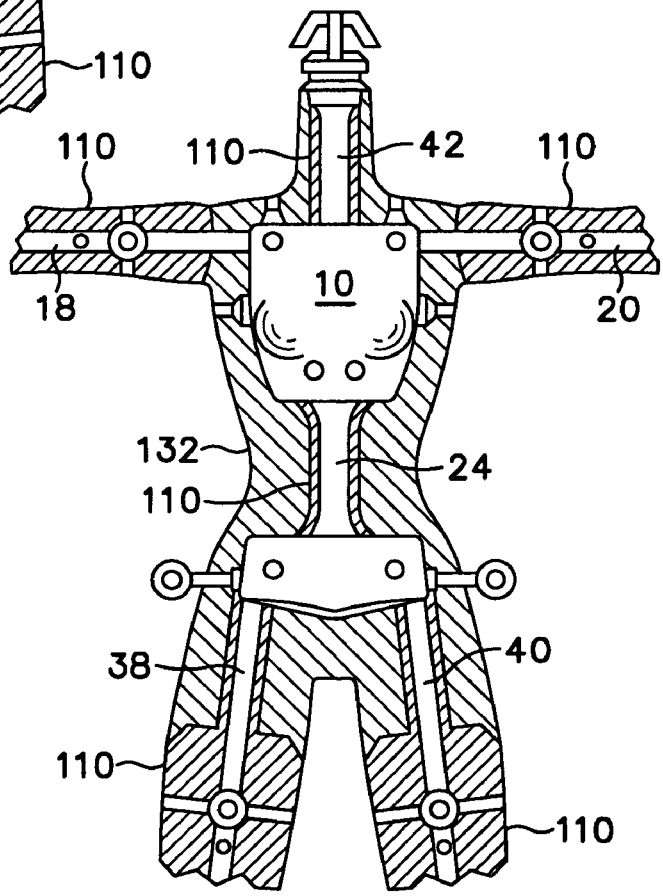
FIG. 10 is a partial front sectional view of a portion of another alternative embodiment of a posable figure.

Another alternative embodiment of a posable figure is depicted in FIG. 10. The embodiment of FIG. 10 is similar to the embodiment depicted in FIG. 9, including inner skeleton 10. However, in FIG. 9, first resilient flexible body material 110 is also molded over neck portion 42 of primary upper member 12 during the first body molding step, to limit flexion of the neck portion.

Figure 11:
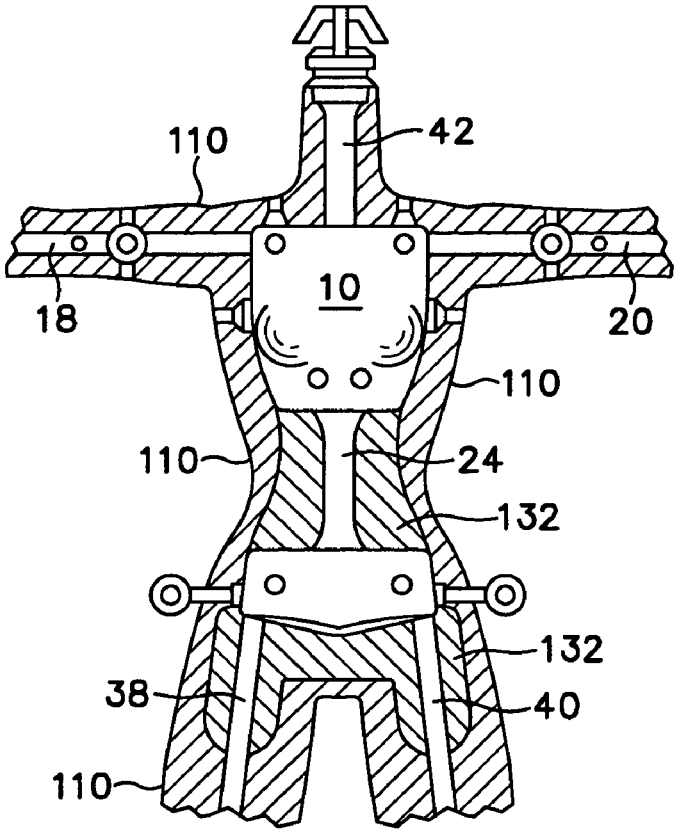
FIG. 11 is a partial front sectional view of a portion of another alternative embodiment of a posable figure.

Another alternative embodiment of a posable figure is depicted in FIG. 11. The embodiment of FIG. 11 includes inner skeleton 10 as depicted in FIG. 1, but second body material 132 is molded only over an inner part of leg portions 38 and 40, and waist portion 24 of the skeleton. In this embodiment, second body material 132 is molded over the skeleton before first body material 110 is molded, since the first body material encloses the second body material.

Figure 12:
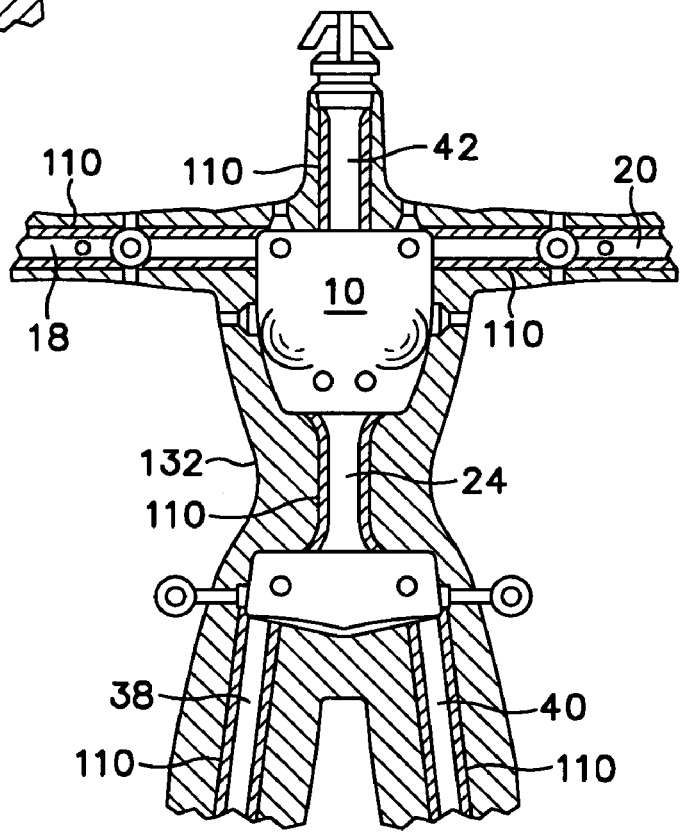
FIG. 12 is a partial front sectional view of a portion of another alternative embodiment of a posable figure.

Still another alternative embodiment of a posable figure is depicted in FIG. 12. The embodiment of FIG. 12 includes inner skeleton 10 as depicted in FIG. 1, with a thickening layer of first body material 110 over all of the primary members of the skeleton. Then, an outer layer of second body material 132 is molded over the skeleton, to form the outer surface of the posable figure.

Figure 13:
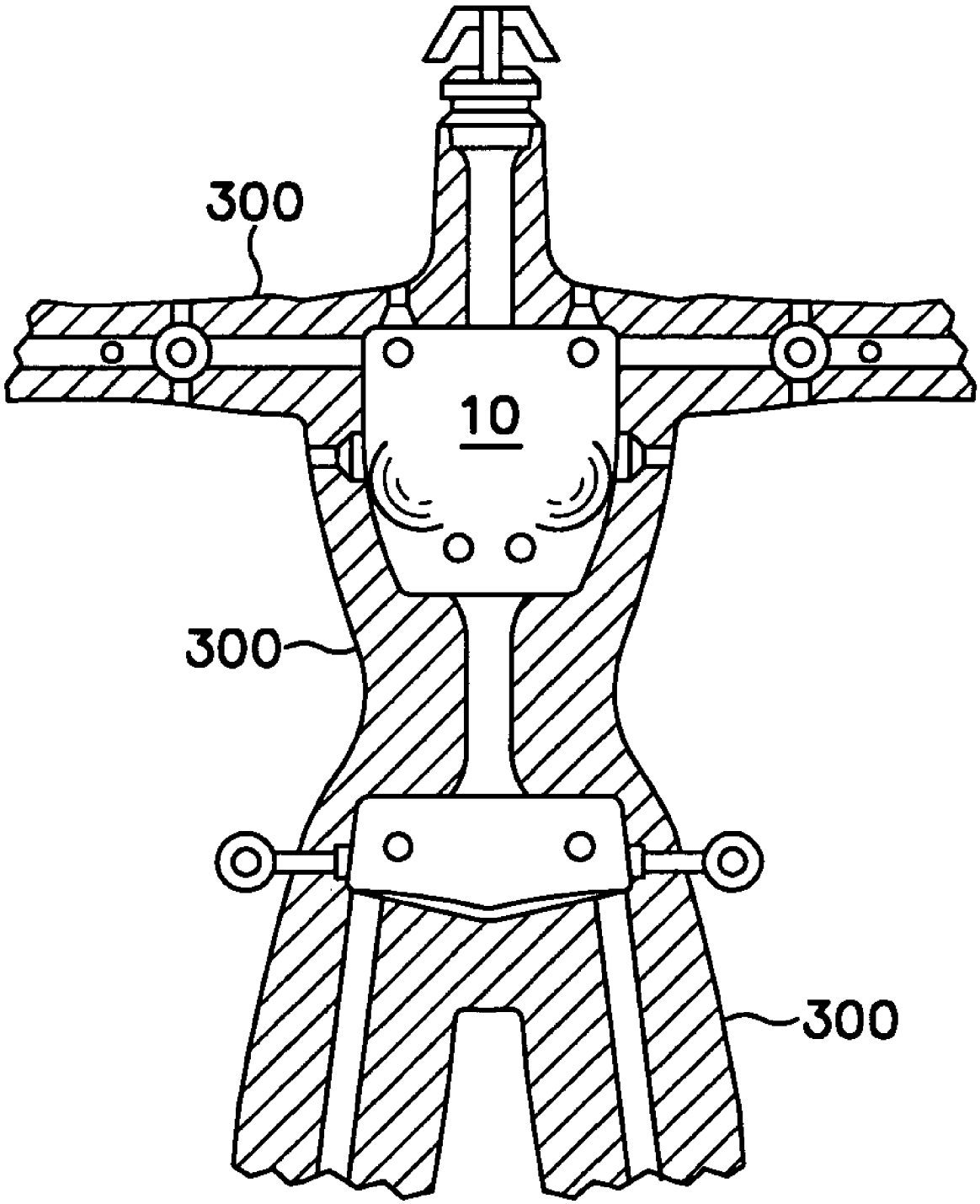
FIG. 13 is a partial front sectional view of a portion of another alternative embodiment of a posable figure.

Yet another alternative embodiment of a posable figure is depicted in FIG. 13, which includes inner skeleton 10 as depicted in FIG. 1, with a single resilient, flexible body material 300 molded around the inner skeleton to form a finished body. Body material 300 may be similar to one of materials 110 or 132, or it may have any other desired elasticity.

Various other alternative embodiments of the toy may include one or more of the bare wire, taper in the legs, overmolded upper leg and waist portions of the skeleton, second-material neck, and inner-portion only of the upper legs or waist, as depicted in FIGS. 7-13. Similarly, other materials may be used to form the inner skeleton and as the first and second resilient, flexible body materials. These other alternative embodiments have not been depicted separately in the drawings.

While the present description has been provided with reference to the foregoing embodiments, those skilled in the art will understand that many variations may be made therein without departing from the spirit and scope defined in the following claims. The description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element or the equivalent thereof, such claims should be understood to include incorporation of one or more such elements, neither requiring, nor excluding, two or more such elements.

We claim:

1. A posable figure comprising:

a body made of at least one flesh-like outer layer molded over an inner skeleton, the skeleton including:

a plurality of primary members, each having first and second ends; and at least one secondary member, molded over the first ends of at least two of the primary members and configured to couple the primary members together to form an integral hip structure;

wherein the primary members each include at least one intermediate bend between the first and second ends, such that a cross-section through the hip structure passes through a corresponding primary member at least twice, the intermediate bend being configured to retain the at least one secondary member at a predefined location on the corresponding primary member.

2. The posable figure of claim 1, the body including a torso and limbs.

3. The posable figure of claim 1, wherein the primary members are continuous.

4. The posable figure of claim 3, wherein the primary members are configured to flex in response to an externally applied force.

5. The posable figure of claim 1, wherein the secondary member is configured to substantially limit flexion of the corresponding primary member where the secondary member is molded over the corresponding primary member.

6. The posable figure of claim 1, the at least one intermediate bend of a primary member disposed near one of the first and second ends and forming a hand portion.

7. A posable figure comprising:

a body having a torso and limbs, the body made of at least one flesh-like outer layer molded over an inner skeleton, the skeleton including:

a plurality of continuous primary members each having first and second ends, the primary members each being configured to flex in response to an externally applied force; and at least one secondary member, molded over a portion of at least two of the primary members and configured to couple the at least two primary members together to form an integral structure, the secondary member being configured to substantially limit flexion of the primary members where the secondary member is molded over the primary members;

wherein each of the primary members includes at least one substantially circular intermediate bend disposed near one of the first and second ends, and wherein the secondary member is molded over at least a portion of the intermediate bend.

8. The posable figure of claim 7, wherein the secondary member is molded over substantially the entire intermediate bend.

9. The posable figure of claim 7, wherein the intermediate bend is configured to retain the secondary member on the primary member.

* * * * *